US011731744B2

(12) United States Patent
Ikegaya

(10) Patent No.: US 11,731,744 B2
(45) Date of Patent: Aug. 22, 2023

(54) CONTROL SYSTEM FOR MARINE PROPULSION DEVICE, CONTROL METHOD FOR THE SAME, AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 323 days.

(21) Appl. No.: 17/203,844

(22) Filed: Mar. 17, 2021

(65) Prior Publication Data

US 2021/0309326 A1 Oct. 7, 2021

(30) Foreign Application Priority Data

Apr. 2, 2020 (JP) ..... 2020-066661

(51) Int. Cl.
*B63B 79/40* (2020.01)
*B63H 1/14* (2006.01)
(Continued)

(52) U.S. Cl.
CPC ..... *B63B 79/40* (2020.01); *B63H 1/14* (2013.01); *B63H 20/00* (2013.01);
(Continued)

(58) Field of Classification Search
CPC ..... B63B 79/40; B63H 1/14; B63H 20/00; B63H 21/21; B63H 2021/202;
(Continued)

(56) References Cited

U.S. PATENT DOCUMENTS 7,677,937 B2 * 3/2010 Ishida ..... B63H 21/213 440/1
2009/0319106 A1 12/2009 Ichikawa et al.
(Continued)

FOREIGN PATENT DOCUMENTS

EP 3 613 663 A1 2/2020
JP 2004-245100 A 9/2004
(Continued)

OTHER PUBLICATIONS

Official Communication issued in corresponding European Patent Application No. 21164679.9, dated Sep. 20, 2021.

*Primary Examiner* — Michael V Kerrigan
(74) *Attorney, Agent, or Firm* — Keating and Bennett, LLP

(57) ABSTRACT

A control system for a marine propulsion device includes a propeller driven by either an engine or a motor. The control system includes a first memory to store first information to identify whether the control system has shut down normally or abnormally even during a reset period of the control system, a second memory to store second information indicating control states of the engine and the motor even during the reset period of the control system, and a controller configured or programmed to start controlling the engine and the motor, based on the second information stored in the second memory, when the first information stored in the first memory indicates an abnormal shutdown of the control system at a startup of the control system.

19 Claims, 4 Drawing Sheets

(51) Int. Cl.
*B63H 20/00* (2006.01)
*F02D 41/00* (2006.01)
*G07C 5/08* (2006.01)

(52) U.S. Cl.
CPC ..... *F02D 41/0002* (2013.01); *G07C 5/0808* (2013.01); *G07C 5/0816* (2013.01)

(58) Field of Classification Search
CPC ..... B63H 2021/205; B63H 2021/216; B63H 21/20; F02D 41/0002; G07C 5/0808; G07C 5/0816
See application file for complete search history.

(56) References Cited

U.S. PATENT DOCUMENTS

| | | | |
|---|---|---|---|
| 2017/0349256 | A1 | 12/2017 | Nakamura |
| 2019/0300136 | A1 | 10/2019 | Nakamura |

FOREIGN PATENT DOCUMENTS

| | | | |
|---|---|---|---|
| JP | 2006-129557 | A | 5/2006 |
| JP | 2008-206288 | A | 9/2008 |
| JP | 2017-218016 | A | 12/2017 |

* cited by examiner

CONTROL SYSTEM FOR MARINE PROPULSION DEVICE, CONTROL METHOD FOR THE SAME, AND MARINE VESSEL

CROSS REFERENCE TO RELATED APPLICATIONS

This application claims the benefit of priority to Japanese Patent Application No. 2020-066661 filed on Apr. 2, 2020. The entire contents of this application are hereby incorporated herein by reference.

BACKGROUND OF THE INVENTION

1. Field of the Invention

The present invention relates to control systems for a marine propulsion device, control methods for the same, and marine vessels.

2. Description of the Related Art

In recent years, so-called hybrid marine propulsion devices equipped with an electric motor and an engine (internal combustion engine) as drive sources have been known (see, for example, Japanese Laid-open Patent Publication (Kokai) No. 2017-218016). In such a marine propulsion device, the operation mode is switched between, for example, an engine drive mode and a motor drive mode. When the operation mode is switched, gears for a propeller are switched by a switch mechanism.

At the time of starting an engine and the time when electric power is used for driving a motor in such a marine propulsion device, a voltage drop can occur in a battery that supplies electric power to a controller that controls the motor. Due to such a battery voltage drop, supply voltage to a control system that controls the marine propulsion device can decrease excessively, resulting in an abnormal shutdown (a reset) of the control system.

When the supply voltage returns to normal, the control system also recovers from the reset. However, after the recovery of the control system, an event in which the operating state of the marine propulsion device before the reset is not reproduced can occur in some cases. For example, in a case that the control system is configured to, after the recovery from the reset, start the control in all situations in a similar manner to the control system that has started when the main power is turned on, the marine propulsion device immediately after the start of the control can be placed in an operating state different from the operating state before the reset, in some cases. When the control system restarts the control of the marine propulsion device in the operating state that is different from the operating state before the reset, the gear switched by the switch mechanism can make a noise or an impact.

SUMMARY OF THE INVENTION

Preferred embodiments of the present invention provide control systems for marine propulsion devices, control methods for the same, and marine vessels, which are each able to reproduce an operating state of the marine propulsion device before a reset of the control system, after the control system recovers from the reset.

According to a preferred embodiment of the present invention, a control system for a marine propulsion device able to drive a propeller by either an engine or a motor includes a first memory to store first information to identify whether the control system has shut down normally or abnormally even during a reset period of the control system, a second memory to store second information indicating control states of the engine and the motor even during the reset period of the control system, and a controller configured or programmed to start controlling the engine and the motor, based on the second information stored in the second memory, when the first information stored in the first memory indicates an abnormal shutdown of the control system at a startup of the control system.

According to another preferred embodiment of the present invention, a control method for use in a control system for a marine propulsion device able to drive a propeller by either an engine or a motor includes storing, with a first memory, first information to identify whether the control system has shut down normally or abnormally even during a reset period of the control system; storing, with a second memory, second information indicating control states of the engine and the motor even during the reset period of the control system; and starting controlling the engine and the motor, with a controller of the control system, based on the second information stored in the second memory, when the first information stored in the first memory indicates an abnormal shutdown of the control system at a startup of the control system.

According to another preferred embodiment of the present invention, a marine vessel includes a marine propulsion device including a propeller, an engine, and a motor each able to drive the propeller. The marine vessel further includes the above-described control system to control the marine propulsion device.

According to a preferred embodiment of the present invention, the first information to identify whether the control system has shut down normally or abnormally is stored in the first memory during not only an operation period of the control system but also an out-of-operation period including, for example, a reset period of the control system, and the second information to indicate control states of the engine and the motor is stored in the second memory during not only the operation period of the control system but also the out-of-operation period including, for example, the reset period of the control system. When the first information stored in the first memory indicates an abnormal shutdown of the control system at a startup of the control system, control of the engine and the motor starts based on the second information stored in the second memory. Accordingly, after the control system recovers from a reset, the operating state of the marine propulsion device before the reset is successfully reproduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
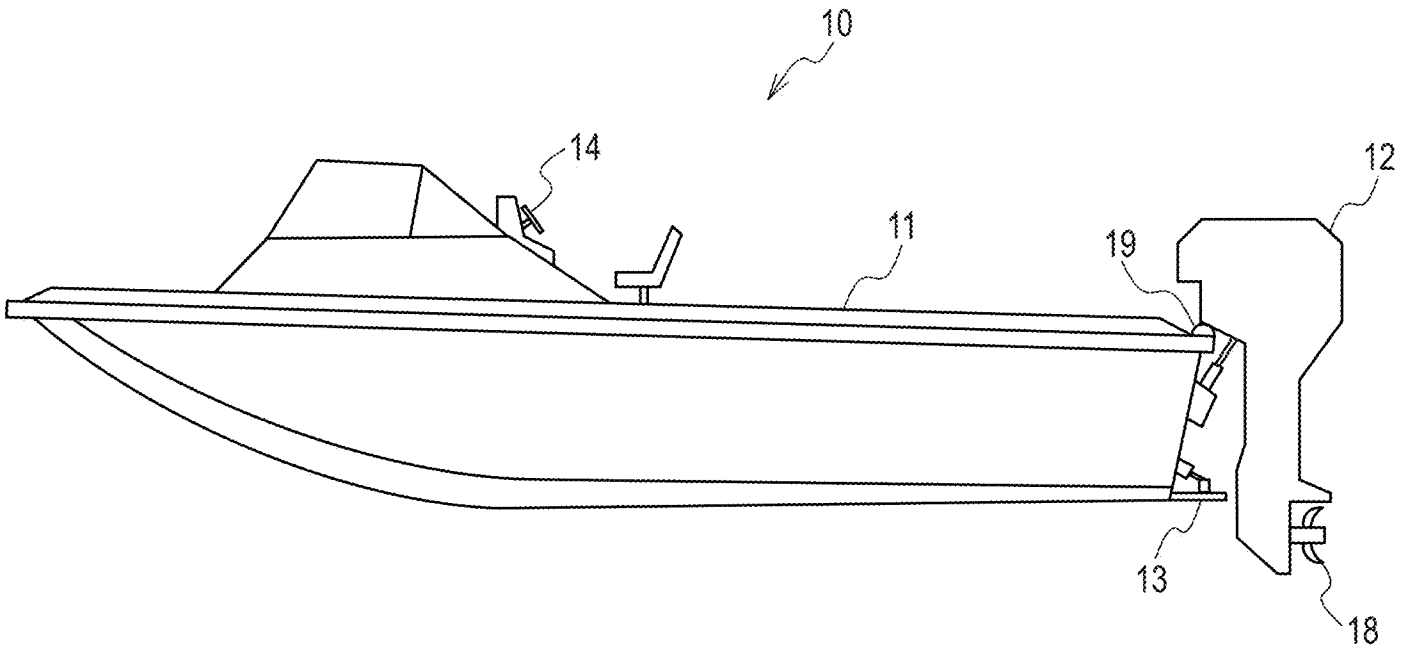
FIG. 1 is a side view of a marine vessel to which a control system for a marine propulsion device according to a preferred embodiment of the present invention is provided.

FIG. 1 is a side view of a marine vessel to which a control system for a marine propulsion device according to a preferred embodiment of the present invention is provided. The marine vessel 10 is, for example, a planing boat, and includes a hull 11, a plurality of outboard motors 12 which define and function as marine propulsion devices mounted on the hull 11, and a plurality of trim tabs 13. A steering wheel 14 and an operation lever 32 (FIG. 2) which will be described below are provided in the vicinity of a vessel steering seat of the hull 11.

The outboard motors 12 are attached to a stern of the hull 11 side by side. Each outboard motor 12 is attached to the hull 11 via a mounting unit 19 so as to turn about a vertical or substantially vertical steering axis in the mounting unit 19 in accordance with an operation on the steering wheel 14. The marine vessel 10 is steered according to the turning of the outboard motors 12. Each trim tab 13 is attached to the stern of the hull 11 so as to swing about a horizontal or substantially horizontal swing axis at the stern. The swinging of the trim tabs 13 adjusts a lift generated at the stern of the hull 11 to control the posture of the hull 11.

Each outboard motor 12 includes two drive sources. One drive source is an engine 23, which is preferably an internal combustion engine, and the other drive source is an electric motor (which is also simply referred to as a "motor") 25. Each outboard motor 12 obtains a propulsion force through a propeller 18 (propulsion blades) rotated by a driving force of its engine 23 or its electric motor 25. That is, each outboard motor 12 is able to drive the propeller 18 with any of the engine 23 and the motor 25.

Figure 2:
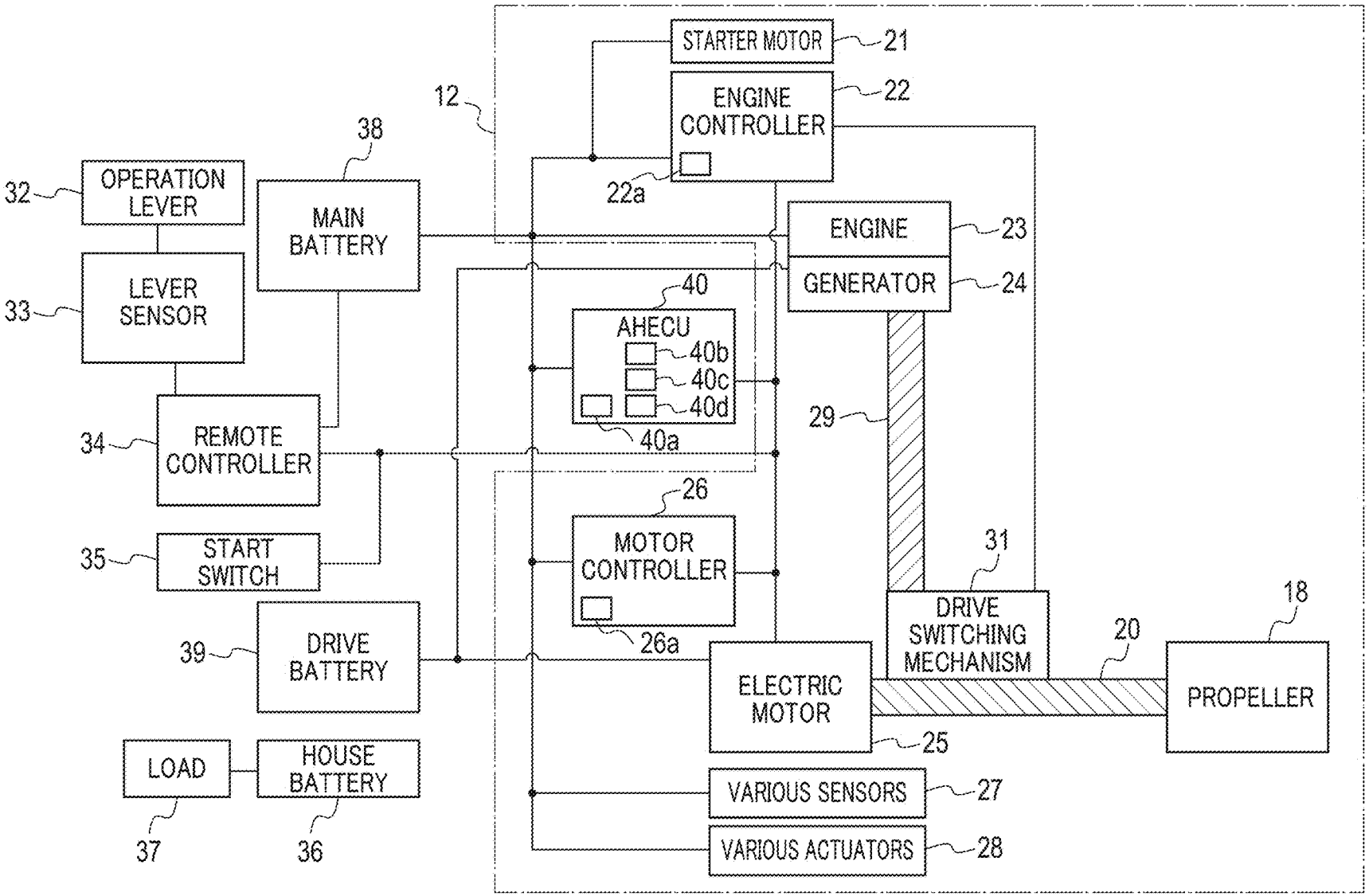
FIG. 2 is a block diagram illustrating an outboard motor and the related configuration.

FIG. 2 is a block diagram illustrating an outboard motor 12 and the related configuration. In FIG. 2, each block is connected to another block by a CAN (Control Area Network), an analog signal line, or a power supply line. In particular, the controllers are connected with each other to enable CAN communication.

The outboard motor 12 includes a starter motor 21, an engine controller 22, an engine 23, a generator 24, an electric motor 25, a motor controller 26, various sensors 27, various actuators 28, and a drive switching mechanism 31. The drive switching mechanism 31 is coupled with the engine 23 through an engine drive shaft 29. The drive switching mechanism 31 is coupled with a propeller shaft 20 (propulsion shaft). A shaft of the electric motor 25 is coupled with the drive switching mechanism 31 and the propeller shaft 20. The propeller 18 is attached to the propeller shaft 20. The drive switching mechanism 31 includes a clutch mechanism, a shift mechanism, and the like, and switches a transmission source of the driving force to the propeller shaft 20 between the engine 23 and the motor 25.

The starter motor 21 starts the engine 23. The engine controller 22 controls the engine 23. The engine controller 22 changes an output of the engine 23 by controlling a throttle actuator and a fuel supply device. The generator 24 generates electric power using rotations of the engine 23. The motor controller 26 controls the motor 25. The various sensors 27 include a sensor to detect the number of rotations of the engine 23, a sensor to detect a throttle opening of the engine 23, and the like. An AHECU (Actuator Head Electronic Control Unit) 40 (controller) acquires the detection results of various sensors 27 from the engine controller 22 and the motor controller 26 through the CAN. The various actuators 28 include a throttle actuator that changes an opening of a throttle valve, and the like. The AHECU 40 includes a processor 40*b*, a storage 40*c*, and a RAM 40*d*, and causes corresponding controllers to control the various actuators 28 through the CAN.

In addition to the AHECU 40, the hull 11 includes an operation lever 32, a lever sensor 33, a remote controller 34, a start switch 35, a house battery 36, a load 37, a main battery 38, and a drive battery 39. The AHECU 40 may be provided for each outboard motor 12.

The main battery 38 supplies the electric power to the AHECU 40, the remote controller 34, the starter motor 21, the engine controller 22, the engine 23, the motor controller 26, the various sensors 27, the various actuators 28, and the like. The drive battery 39 supplies the electric power to the motor 25. The house battery 36 supplies the electric power to the load 37, such as a television, on the marine vessel. A combination of a power supply source and a power supply destination is not limited to the above examples.

The AHECU 40 includes a first storage 40*a* (which is also referred to as a first memory) preferably including a rewritable nonvolatile memory such as an EEPROM. The engine controller 22 and the motor controller 26 respectively include an engine memory 22*a* and a motor memory 26*a* as a second storage (which is also referred to as a second memory) preferably including a rewritable nonvolatile memory.

The operation lever 32 is included in a remote controller unit (which is not illustrated), the lever sensor 33 detects an operation position of the operation lever 32, and sends a detection result to the remote controller 34. The remote controller 34 generates a request value of the throttle opening and a request torque, based on the detection result acquired from the lever sensor 33, and outputs the request value and the request torque to the AHECU 40. The AHECU 40 sends the values received from the remote controller 34 to the engine controller 22 and the motor controller 26, as an output request. In this process, the AHECU 40 classifies the received values according to the operating condition, and sends the received values to the engine controller 22 and the motor controller 26 according to the classification. The engine controller 22 drives the engine 23 in accordance with the received output request. The motor controller 26 drives the motor 25 in accordance with the received output request. When the AHECU 40 outputs an engine start instruction to the engine controller 22, the engine controller 22 causes the starter motor 21 to start the engine 23. In this case, the engine controller 22 drives a relay, and accordingly, the starter motor 21 obtains the electric power from the main battery 38, and starts the engine 23.

The start switch 35 is positioned at an operation position of any of an OFF position, an ON position, and a START position by an operation of a vessel operator. When the vessel operator positions the start switch 35 at the START position by hand and then releases the hand from the start switch 35, the start switch 35 automatically returns to the ON position. The START position is an operation position to activate the starter motor 21 and to cause the AHECU 40 to store the fact that the activation of the starter motor 21 has been permitted. When a start permission instruction to permit the start of the engine 23 is input into the AHECU 40, information that the start of the engine 23 has been permitted is stored in the AHECU 40. The stored information is held until the start switch 35 is moved to the OFF position.

It is to be noted that the configuration of the start switch 35 is not limited to this. For example, a main switch and a start/stop switch may be provided, and while the main switch is on, the start/stop switch may be operated to activate or stop activating the starter motor 21.

The second storage (engine memory 22*a* and motor memory 26*a*) stores second information (mode information and at least one instruction value) indicating control states of the engine 23 and the motor 25. The mode information includes information indicating an operation mode of the outboard motor 12, which will be described below. Each instruction value is a value used to control the engine 23 or the motor 25. The engine memory 22*a* stores at least one instruction value to control the engine 23, which includes at least one of an instruction value of a target number of rotations of the engine 23, an instruction value of a target torque of the engine 23, an instruction value of a shift position of the shift mechanism of the outboard motor 12 (drive switching mechanism 31), an instruction value of the throttle opening of the engine 23, and a value indicating a failure state of the engine 23. The motor memory 26*a* stores at least one instruction value to control the motor 25, which includes at least one of an instruction value of a target number of rotations of the motor 25, an instruction value of a target torque of the motor 25, a value indicating a driving state of the motor 25, and a value indicating a failure state of the motor 25.

In place of the AHECU 40 (controller), the engine controller 22 and the remote controller 34 may be modified such that one of the controllers includes the functions of the AHECU 40 and is integrated to serve as a controller. Alternatively, as the controller, a battery controller that integrally controls the main battery 38, the drive battery 39, and the house battery 36 may be provided. The battery controller may include a non-volatile memory that stores instruction values to control the batteries.

A description of the operation mode of the outboard motor 12 will now be provided. The operation mode of the outboard motor 12 includes at least a first mode in which the outboard motor 12 is driven by the engine 23 without using the driving force of the motor 25, and a second mode in which the outboard motor 12 is driven by the motor 25 without using the driving force of the engine 23. In the present preferred embodiment, the operation mode of the outboard motor 12 includes a stop mode, a first motor drive mode (second mode), a second motor drive mode (second mode), an engine mode (first mode), a first synchronization mode, and a second synchronization mode. The stop mode is a mode in which both the engine 23 and the motor 25 are stopped. The first motor drive mode is a mode in which the engine 23 is stopped and the propeller 18 is driven exclusively by the motor 25 with the electric power from the drive battery 39. The second motor drive mode is a mode in which the propeller 18 is driven exclusively by the motor 25 with the electric power from the drive battery 39, while the drive battery 39 is being charged by the electric power generated by the generator 24, which is caused by the engine 23. The engine mode is a mode in which the motor 25 is stopped and the propeller 18 is driven exclusively by the engine 23.

The first synchronization mode is a mode that the operation mode of the outboard motor 12 enters when transitioning from one of the stop mode, the first motor drive mode, the second motor drive mode, and the engine mode, to another. The second synchronization mode is a mode that the operation mode of the outboard motor 12 enters when transitioning from one of the stop mode, the second motor drive mode, and the engine mode, to another. The first synchronization mode and the second synchronization mode are provided to smooth the transition of the operation mode of the outboard motor 12, and are controlled according to the shift position of the shift mechanism of the outboard motor 12 (drive switching mechanism 31), the number of rotations of the engine, the number of rotations of the motor, and the like. In the present preferred embodiment, there is no mode to drive the propeller 18 by using the power provided by the engine 23 and the power provided by the motor 25 in combination.

Figure 3:
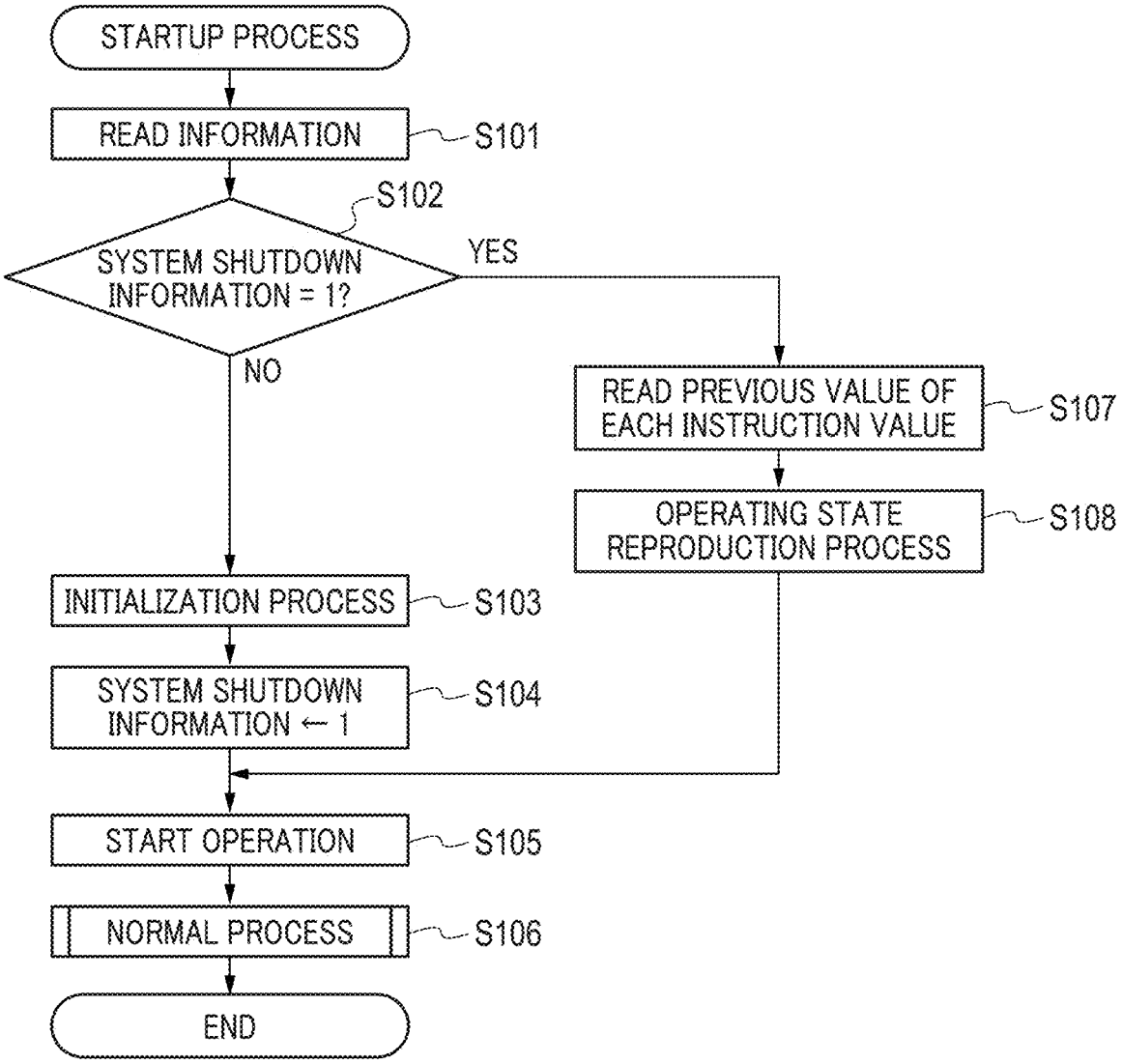
FIG. 3 is a flowchart illustrating a startup process.

FIG. 3 is a flowchart illustrating a startup process of the control system of the outboard motor 12. This process is realized by the processor 40*b* of the AHECU 40 running or executing a control program, which is stored beforehand in the storage 40*c*, in the RAM 40*d* and executing the program. This process is started when the main power of the marine vessel 10 is turned on or when the control system of the outboard motor 12 recovers from a reset caused by an instantaneous voltage drop.

When a voltage drop occurs in the main battery 38, the supply voltage to the AHECU 40 drops excessively, and the control system including the AHECU 40 might shut down abnormally, in other words, is subjected to a reset. After that, when the supply voltage returns to normal while the start switch 35 is in the ON position, the control system is released from the reset and then recovers. That is, the control system recovers from the reset.

When the startup process is started, the AHECU 40 might not be able to identify whether this startup process is a normal startup process caused by an operation of the start switch 35 or a restart process caused after recovery from a reset. In the present preferred embodiment, the AHECU 40 is configured or programmed to determine whether the current startup process of the control system of the outboard motor 12 is caused by the normal start or recovery from a reset, and start the control of the engine 23 and the motor 25 appropriately.

In step S101, the AHECU 40 reads system shutdown information (first information) from the first storage 40*a*, and also reads mode information out of second information from the second storages (memories 22*a* and 26*a*). The system shutdown information includes information to identify whether the control system has shut down normally or abnormally. The value "0" (second value) of the system shutdown information indicates that the system has shut down normally, and the value "1" (first value) of the system shutdown information indicates that the system has shut down abnormally (an instantaneous voltage drop has occurred). Therefore, the system shutdown information=0 indicates normal startup, and system shutdown information=1 indicates recovery from a reset.

The mode information includes information that indicates an operation mode (a portion of the control state of the engine 23 and the motor 25) of the outboard motor 12 immediately before the startup. The value of the mode information is set to any of "0" to "5" respectively corresponding to the stop mode, the first motor drive mode, the second motor drive mode, the engine mode, the first synchronization mode, and the second synchronization mode. For example, when the mode information=4, this means that an immediately previous operation mode of the outboard motor 12 is the engine mode. Even during the reset period of the control system, the first storage 40*a* stores the system shutdown information, and the second storage stores the second information (mode information and at least one instruction value).

In step S102, the AHECU 40 determines whether the current startup is caused by recovery from an instantaneous voltage drop (reset release). When the system shutdown information=0 (NO in step S102), the AHECU 40 determines that the current startup process is a normal startup process and advances the process to step S103. On the other hand, when the system shutdown information=1 (YES in step S102), the AHECU 40 determines that the current startup process is a restart process caused by recovery from a reset, and advances the process to step S107.

In step S103, the AHECU 40 performs an initialization process of the second information. That is, the AHECU 40 sets "0" to the mode information and resets instruction value information. Here, for example, AHECU 40 outputs 0 as each instruction value. Subsequently, the AHECU 40 advances the process to step S104. Therefore, when the system shutdown information=0 at a startup of the control system, the AHECU 40 initializes the second information stored in the second storage, and shifts to start controlling the engine 23 and the motor 25.

In step S104, the AHECU 40 sets "1" to the system shutdown information stored in the first storage 40*a*. That is, after the control system starts up, the AHECU 40 causes the first storage 40*a* to store a value of "1" indicating that the control system has shut down abnormally as the system shutdown information. Accordingly, the system shutdown information stored in the first storage 40*a* is maintained at "1" until the control system of the outboard motor 12 shuts down normally. In step S105, the AHECU 40 starts the operation of the outboard motor 12. When the process proceeds from step S104, the operation of the outboard motor 12 starts in the stop mode and from a state in which the output of each instruction value is 0.

In step S107, the AHECU 40 reads a previous value or values of at least one instruction value from the second storage. The second information is updated as needed during the operation of the outboard motor 12, and latest values are stored in the second storage (S203 and S205 to be described below). Therefore, the information stored in the second storage when the control system of the outboard motor 12 recovers from a reset includes at least one instruction value stored in the second storage immediately before the reset. In step S108, the AHECU 40 performs an operating state reproduction process. That is, the AHECU 40 sets the mode information read in step S101 as the mode information at the time of starting controlling the outboard motor 12, and also sets the previous value or values of at least one instruction value read in step S107 as at least one instruction value used to control the engine 23 and/or the motor 25. Subsequently, the AHECU 40 advances the process to step S105. The AHECU 40 starts the operation of the outboard motor 12. That is, the AHECU 40 starts controlling the engine 23 and the motor 25 based on the second information stored in the second storage. In a case of shifting from step S108, control of the engine 23 and motor 25 is restarted under the same conditions as those before the reset. Accordingly, the operating state of the outboard motor 12 immediately before the reset is reproduced. It eliminates, for example, unnecessary switching of the gears by the drive switching mechanism 31 and significantly reduces or prevents the generation of noise or impacts of the gears.

In step S106, the AHECU 40 performs a normal process (FIG. 4) and ends the process illustrated in FIG. 3.

Figure 4:
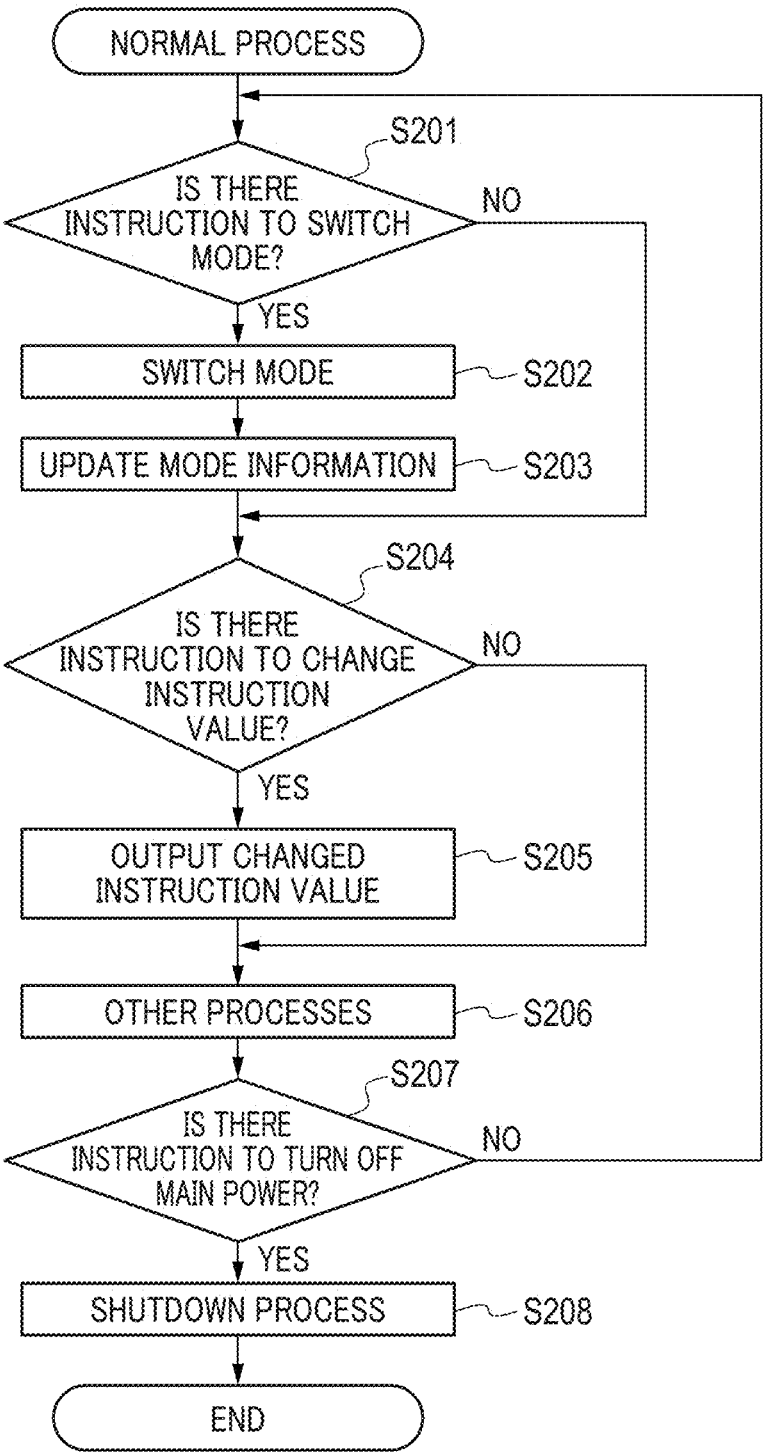
FIG. 4 is a flowchart illustrating a normal process.

FIG. 4 is a flowchart illustrating a normal process performed in step S106 of FIG. 3. In step S201, the AHECU 40 determines whether there is an instruction to switch the operation mode of the outboard motor 12. Such a mode switching instruction is input by a vessel operator via a setting operation unit which is not illustrated. When there is no instruction to switch the operation mode of the outboard motor 12, the AHECU 40 advances the process to step S204. When there is an instruction to switch the operation mode of the outboard motor 12, the AHECU 40 switches the operation mode of the outboard motor 12 according to the mode switching instruction in step S202. That is, the AHECU 40 sets one of the above-mentioned plurality of operation modes. In step S203, the AHECU 40 causes the second storage (memories 22*a* and 26*a*) to store the mode information indicating the operation mode of the outboard motor 12 changed or set by the AHECU 40. Subsequently, the AHECU 40 advances the process to step S204.

In step S204, the AHECU 40 determines whether there is an instruction to change the at least one instruction value. When there is no instruction to change the at least one instruction value, AHECU 40 advances the process to step S206. On the other hand, when there is an instruction to change any of the at least one instruction value, the AHECU 40 outputs the corresponding changed instruction value or values in step S205. Accordingly, among the engine controller 22 and the motor controller 26, the controller that receives the corresponding changed instruction value or values, drives the engine 23 or the motor 25, based on the corresponding changed instruction value or values received. In addition to this, the AHECU 40 causes the second storage (memories 22*a* and 26*a*) to store the instruction value or values that have been output. Subsequently, the AHECU 40 advances the process to step S206.

In step S206, the AHECU 40 performs "other processes". In the "other processes" mentioned here, for example, various processes corresponding to settings and operations provided through the setting operation unit are performed.

In step S207, the AHECU 40 determines whether there is an instruction to turn off the main power of the marine vessel 10 by operating the start switch 35. Then, the AHECU 40 returns the process to step S201 when there is no instruction to turn off the main power. When there is an instruction to turn off the main power, the AHECU 40 performs a shutdown process of the control system of the outboard motor 12 in step S208, and then ends the process illustrated in FIG. 4. In this shutdown process, the AHECU 40 sets "0" to the mode information and "0" to the system shutdown information. That is, upon the control system shutting down normally, the AHECU 40 causes the first storage 40*a* to store a second value indicating that the control system has shut down normally as the first information, instead of the first value. Therefore, until the next normal startup of the control system of the outboard motor 12, the second storage stores the mode information of the value "0" and also stores at least one current instruction value so that the at least one current instruction value is able to be referred to as a previous value or values later. In addition, the first storage 40*a* stores the system shutdown information having a value of "0", until the next normal startup of the control system of the outboard motor 12.

Assuming that the control system shuts down abnormally before performing step S208, the value of the system shutdown information stored by the first storage 40*a* is "1". Therefore, the AHECU 40 is able to identify whether the current startup is caused by normal startup or recovery from a reset from the value of the system shutdown information at the next startup time of the control system of the outboard motor 12. When the control system of the outboard motor 12 shuts down abnormally before performing step S208, the value of the mode information and at least one instruction value stored by the second storage are the values provided immediately before the abnormal shutdown. Therefore, by using such information, the AHECU 40 is able to reproduce the operating state of the outboard motor 12 before the reset.

According to the present preferred embodiment, the first storage 40*a* stores the system shutdown information (first information) even during the reset period, and the second storage stores the second information (mode information and at least one instruction value) even during the reset period. The AHECU 40 starts controlling the engine 23 and the motor 25, based on the second information stored in the second storage, in when the system shutdown information stored in the first storage 40*a* indicates the abnormal shutdown of "1" (S107→S108→S105) at a startup of the control system. Accordingly, after the control system of the outboard motor 12 recovers from a reset, the operating state of the outboard motor 12 before the reset is reproduced.

In particular, since the second information includes information indicating the operation mode of the outboard motor 12 that has been set, the operation mode of the outboard motor 12 before the reset is successfully reproduced after the control system of the outboard motor 12 recovers from the reset. In addition, since the second information includes at least one instruction value to control the engine 23 or the motor 25, the control state of the engine 23 or the motor 25 before the reset is successfully reproduced after the control system of the outboard motor 12 recovers from the reset.

Further, when the system shutdown information is "0" at a startup of the control system, the control of the engine 23 and the motor 25 is started after the second information is initialized (S103). Therefore, the control is started at always the same operating state at the time of normal startup.

It is to be noted that the timing when the AHECU 40 causes the first storage 40*a* to store the system shutdown information is not limited to that described above. That is, the timing when the AHECU 40 causes the first storage 40*a* to store the system shutdown information of the value "1" may be any time after the control system is started, and the timing when the AHECU 40 causes the first storage 40*a* to store the system shutdown information of the value "0", instead of the value "1", may be any time when the control system shuts down normally.

It is to be noted that the first storage 40*a* that stores the system shutdown information (first information) may not necessarily be a memory in the AHECU 40. The second storage that stores the second information may not necessarily be a memory in the engine controller 22 or the motor controller 26. For example, the mode information may be stored in only one of the engine memory 22*a*, the motor memory 26*a*, and the first storage 40*a*.

It is to be noted that a non-volatile memory in the battery controller may store instruction values to control batteries by a battery controller, which is not illustrated, as the second information. With such a configuration, the control state of each battery before the reset is successfully reproduced at the time of recovery from the reset.

The number of the outboard motors 12 provided on the marine vessel 10 may be one, or three or more. The trim tabs 13 may not necessarily be provided.

A marine vessel to which preferred embodiments of the present invention are applied is not limited to a marine vessel including an outboard motor, and may be a marine vessel including another type of marine propulsion device, such as an inboard/outboard motor (stern drive, inboard motor/outboard drive), an inboard motor, a water jet drive, and the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A control system for a marine propulsion device able to drive a propeller by either an engine or a motor, the control system comprising:

a first memory to store first information to identify whether the control system has shut down normally or abnormally even during a reset period of the control system;

at least one second memory to store second information indicating control states of the engine and the motor even during the reset period of the control system; and a controller configured or programmed to start controlling the engine and the motor, based on the second information stored in the at least one second memory, when the first information stored in the first memory indicates an abnormal shutdown of the control system at a startup of the control system.

2. The control system according to claim 1, wherein when the first information stored in the first memory indicates a normal shutdown of the control system at a startup of the control system, the controller is configured or programmed to initialize the second information stored in the at least one second memory and then start controlling the engine and the motor.

3. The control system according to claim 1, wherein after the control system starts up, the controller is configured or programmed to cause the first memory to store a first value as the first information indicating that the control system has shut down abnormally; and when the control system shuts down normally, the controller is configured or programmed to cause the first memory to store, instead of the first value, a second value as the first information indicating that the control system has shut down normally.

4. The control system according to claim 1, wherein the controller is configured or programmed to set one of a plurality of operation modes including a first mode in which the marine propulsion device is driven by the engine without using a driving force of the motor, and a second mode in which the marine propulsion device is driven by the motor without using a driving force of the engine; and the second information includes information indicating an operation mode set by the controller.

5. The control system according to claim 4, wherein the second information includes at least one instruction value to control the engine or the motor.

6. The control system according to claim 1, wherein the controller is configured or programmed to control an engine controller to control the engine; and the at least one second memory stores a previous value or values of at least one instruction value to control the engine by the engine controller as the second information during the reset period of the control system.

7. The control system according to claim 6, wherein the at least one instruction value to control the engine includes at least one of an instruction value of a target number of rotations of the engine, an instruction value of a target torque of the engine, an instruction value of a shift position of a shift mechanism of the marine propulsion device, an instruction value of a throttle opening of the engine, and a value indicating a failure state of the engine.

8. The control system according to claim 1, wherein the controller is configured or programmed to control a motor controller to control the motor; and the at least one second memory stores a previous value or values of at least one instruction value to control the motor by the motor controller as the second information during the reset period of the control system.

9. The control system according to claim 8, wherein the at least one instruction value to control the motor includes at least one of an instruction value of a target number of rotations of the motor, an instruction value of a target torque of the motor, a value indicating a driving state of the motor, and a value indicating a failure state of the motor.

10. The control system according to claim 1, wherein the first memory includes a non-volatile memory.

11. A control method for use in a control system for a marine propulsion device able to drive a propeller by either an engine or a motor, the control method comprising:

storing, with a first memory, first information to identify whether the control system has shut down normally or abnormally even during a reset period of the control system;

storing, with at least one second memory, second information indicating control states of the engine and the motor even during the reset period of the control system; and starting controlling the engine and the motor, with a controller of the control system, based on the second information stored in the at least one second memory, when the first information stored in the first memory indicates an abnormal shutdown of the control system at a startup of the control system.

12. The control method according to claim 11, further comprising:

when the first information stored in the first memory indicates a normal shutdown at a startup of the control system, initializing, with the controller, the second information stored in the at least one second memory and then starting controlling the engine and the motor.

13. The control method according to claim 11, further comprising:

after the control system starts up, causing, with the controller, the first memory to store a first value indicating that the control system has shut down abnormally as the first information; and when the control system shuts down normally, causing, with the controller, the first memory to store, instead of the first value, a second value indicating that the control system has shut down normally as the first information.

14. The control method according to claim 11, further comprising:

setting, with the controller, one of a plurality of operation modes including a first mode in which the marine propulsion device is driven by the engine without using a driving force of the motor, and a second mode in which the marine propulsion device is driven by the motor without using a driving force of the engine; wherein the second information includes information indicating an operation mode set by the controller.

15. The control method according to claim 11, wherein the second information includes at least one instruction value to control the engine or the motor.

16. The control method according to claim 11, wherein the storing of the second information, includes storing, with the at least one second memory, a previous value or values of at least one instruction value to control the engine with an engine controller that controls the engine as the second information during the reset period of the control system.

17. The control method according to claim 11, wherein the storing of the second information, includes storing, with the at least one second memory, a previous value or values of at least one instruction value to control the motor by a motor controller that controls the motor as the second information during the reset period of the control system.

18. The control method according to claim 11, wherein the first memory includes a non-volatile memory.

19. A marine vessel comprising:

a marine propulsion device including a propeller, an engine, and a motor, wherein the engine and the motor are each able to drive the propeller; and a control system to control the marine propulsion device and including:

a first memory to store first information to identify whether the control system has shut down normally or abnormally even during a reset period of the control system;

at least one second memory to store second information indicating control states of the engine and the motor even during the reset period of the control system; and a controller configured or programmed to start controlling the engine and the motor, based on the second information stored in the at least one second memory, when the first information stored in the first memory indicates an abnormal shutdown of the control system at a startup of the control system.

* * * * *